US005862713A

United States Patent [19]

Tsunoda et al.

[11] Patent Number: 5,862,713

[45] Date of Patent: Jan. 26, 1999

[54] THROTTLE LEVER DEVICE FOR ENGINE

[75] Inventors: Shuhei Tsunoda, Gunma-gun; Minoru Shibasaki, Kitagunma-gun; Yukinobu Tomaru, Takasaki-gun; Hidenobu Takahashi, Gunma, all of Japan

[73] Assignee: Starting Industrial Co., Ltd., Japan

[21] Appl. No.: 657,790

[22] Filed: May 31, 1996

[51] Int. Cl.[6] ..... G05G 1/04

[52] U.S. Cl. ..... 74/526; 74/489; 30/381; 123/398

[58] Field of Search ..... 74/526, 527, 501.6, 74/513, 482, 489; 30/381, 382

[56] References Cited

U.S. PATENT DOCUMENTS

| | | | |
|---|---|---|---|
| 2,610,657 | 9/1952 | Kiekhaefer | 30/383 |
| 3,361,165 | 1/1968 | Irgens | 30/381 |
| 3,683,716 | 8/1972 | Anderson | 74/489 |
| 3,688,599 | 9/1972 | St. Germain | 74/526 |
| 3,774,303 | 11/1973 | Burkett et al. | 30/382 |
| 4,028,804 | 6/1977 | Hammond | 30/382 |
| 4,186,291 | 1/1980 | Swanson | 200/61.86 |
| 4,237,997 | 12/1980 | Swanson | 123/335 |
| 4,302,880 | 12/1981 | Elfving et al. | 30/382 |
| 4,528,954 | 7/1985 | Slattery | 123/413 |
| 5,239,891 | 8/1993 | Stocker | 74/513 |
| 5,365,802 | 11/1994 | Suzuki et al. | 74/482 |

FOREIGN PATENT DOCUMENTS

| | | | |
|---|---|---|---|
| 417124 | 2/1981 | Sweden | 30/382 |

*Primary Examiner*—Vinh T. Luong
*Attorney, Agent, or Firm*—Lerner, David, Littenberg, Krumholz & Mentlik

[57] ABSTRACT

A throttle lever device for an engine having a decreased number of parts and capable of facilitating an assembling operation. An operation grip for controlling an engine of a mowing machine or the like is provided on opposite sides thereof with a throttle lever and a lock lever engageable with the throttle lever, respectively. A lock button is arranged in proximity to the lock lever so as to hold the throttle lever at a half throttling position. The throttle lever, lock lever and lock button are arranged so as to be pushable in toward a center of the operation grip. The lock lever and lock button are formed integrally with each other and constantly urged by an elastic member so as to be projected outwardly of the operation grip.

12 Claims, 6 Drawing Sheets

THROTTLE LEVER DEVICE FOR ENGINE

BACKGROUND OF THE INVENTION

This invention relates to a throttle lever device for an engine, and more particularly to an improvement in a structure including a throttle lever, a lock lever and a lock button which are arranged on an operation grip of a mowing machine, a chain saw or the like.

A conventional mowing machine or a chain saw generally includes an operation grip, which is provided with a throttle lever for controlling rotation of an engine of the mowing machine or chain saw. Thus, when the operation grip is gripped during carrying of the machine or saw, transportation thereof or the like, the throttle lever is pushedly operated or pushed in concurrently, resulting in a blade of the mowing machine or the chain saw being often driven accidentally or unintentionally. In order to eliminate such unintended driving, a lock lever is arranged opposite to the throttle lever, so that the throttle lever is kept from being actuated unless the lock lever is operated.

Also, in the conventional mowing machine or chain saw, it is required to push in the throttle lever to an intermediate position in a movable range to keep it at a half throttling state at the time when the engine is started. For this purpose, a throttle lever device is provided which is so constructed that a lock button is arranged on the throttle lever in a manner to be in proximity to the lock lever. The lock button is adapted to be engaged with the throttle lever kept at the half throttling state, resulting in holding it at the half throttling state.

The operation grip is constructed of two grip members or halves laterally split from each other, which are provided with the throttle lever, the lock lever, the lock button, a spring and the like which constitute a main part of the throttle lever device. Then, the two grip halves are joined together, resulting in the throttle lever device being assembled. Mounting of the above-described members on the two grip halves is carried out in such a manner that one of the grip halves is mounted thereon with the throttle lever and the other grip half is mounted with the lock lever and lock button, followed by joining of the halves to each other.

However, in the prior art, it is required to carry out joining between the two grip halves while keeping the members from being unintendedly removed from the halves. Also, it is required that the members are each provided with a small-sized spring which acts to force or urge the member, to thereby outwardly project it. Thus, the joining is highly troublesome, resulting in requiring a great deal of skill.

SUMMARY OF THE INVENTION

The present invention has been made in view of the foregoing disadvantage of the prior art.

Accordingly, it is an object of the present invention to provide a throttle lever device for an engine which has a decreased number of parts and is capable of facilitating assembling operation thereof.

In accordance with the present invention, a throttle lever device for control of an engine is provided. The throttle lever device includes an operation grip, and a throttle lever and a lock lever arranged on opposite sides of the operation grip and constructed so as to be pushable in toward a center of the operation grip. The lock lever is arranged so as to be engageable with the throttle lever. The throttle lever device also includes a lock button for holding the throttle lever at a half throttling position. The lock button is arranged in proximity to the lock lever and constructed so as to be pushable in toward the center of the operation grip. The throttle lever is provided with a first engagement engageable with the lock lever and a second engagement engageable with the lock button. The first engagement of the throttle lever is normally kept engaged with the lock lever and is released from engagement with the lock lever when the lock lever is pushed in. The lock button is pushed in to the half throttling position, to thereby be engaged with the second engagement of the throttle lever when the throttle lever is pushed in to the half throttling position, resulting in the throttle lever being held at the half throttling position. The lock button is released from engagement with the second engagement of the throttle lever when the throttle lever is pushed further in. The lock lever and lock button are formed in a manner to be integral with each other and constantly urged by an elastic means so as to be projected outwardly of the operation grip.

In a preferred embodiment of the present invention, the lock lever is formed of synthetic resin into a U-shape by folding it, the lock lever is provided at one end thereof with a lock element engageable with the first engagement of the throttle lever, and the lock lever is extended at the other end thereof and provided thereat with the lock button.

In a preferred embodiment of the present invention, the lock lever is pivotally supported on the operation grip and the throttle lever includes a throttle wire mounting section and a lever section for operation and is pivotally supported on the operation grip, wherein the lever section is urged by an elastic member so as to be projected outwardly of the operation grip.

In a preferred embodiment of the present invention, the operation grip is constructed of first and second hollow grip members and throttle lever and lock lever are mounted substantially in one of the grip members.

In a preferred embodiment of the present invention, the elastic means for urging the lock lever and lock button comprises a folded section of the lock lever which functions as an elastic hinge.

In a preferred embodiment of the present invention, the operation grip is provided with a regulation member engageable with the lock lever in order to prevent the lock lever from being excessively projected from the operation grip.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein:

FIG. 5 is a sectional view through plane II—II of FIG. 1 showing an essential part of the throttle lever device of FIG. 2 in which a lock lever is pushedly operated or pushed in; and FIG. 6 is a sectional view showing through plane II—II of FIG. 1 an essential part of the throttle lever device of FIG. 2 in which a lock button is pushedly operated or pushed in.

DETAILED DESCRIPTION OF THE PREFERRED EMBODIMENT

Now, a throttle lever device according to the present invention will be described hereinafter with reference to the accompanying drawings.

Figure 1:
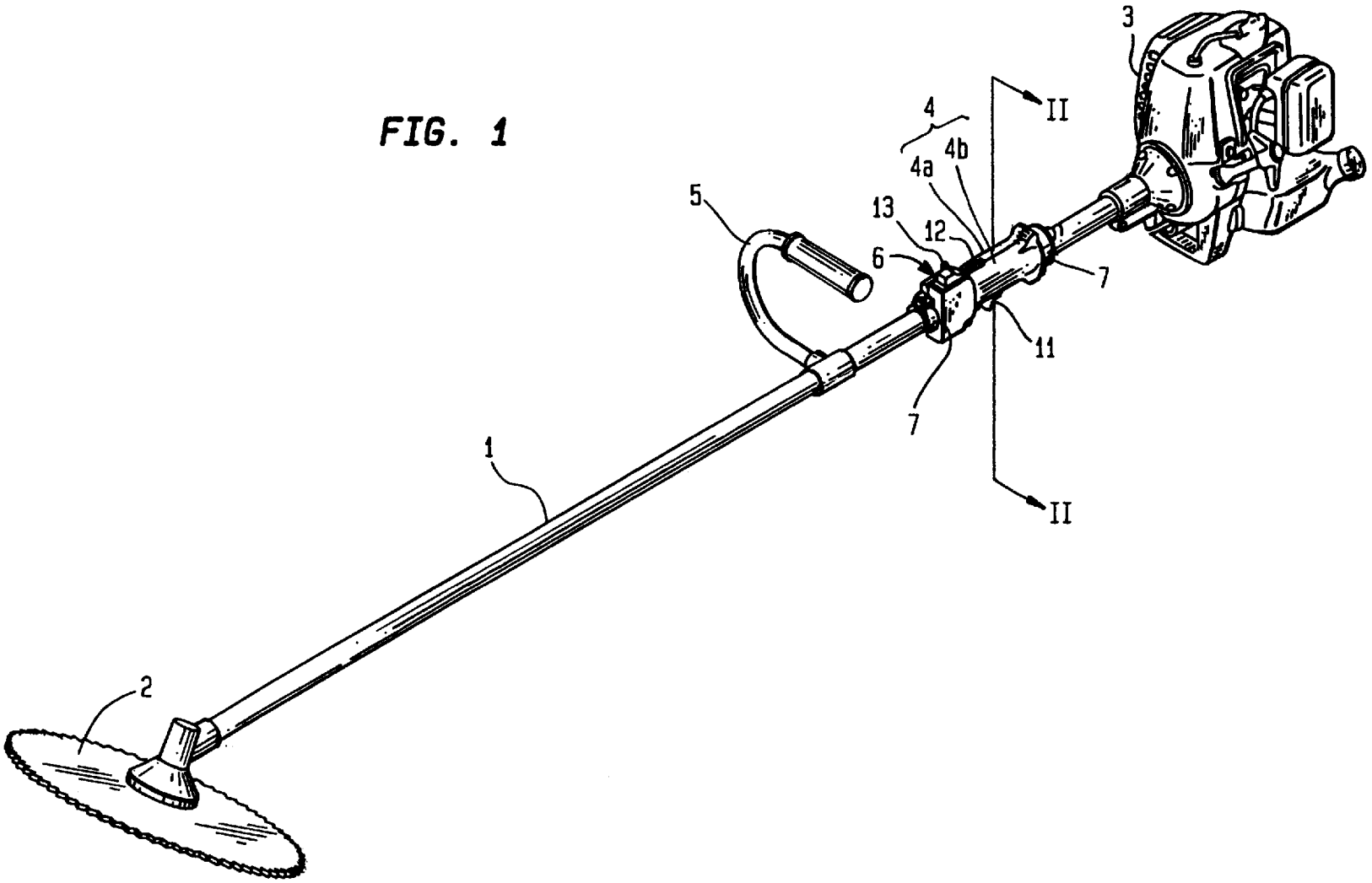
FIG. 1 is a perspective view generally showing an example of a mowing machine to which a throttle lever device according to the present invention may be applied.
Figure 2:
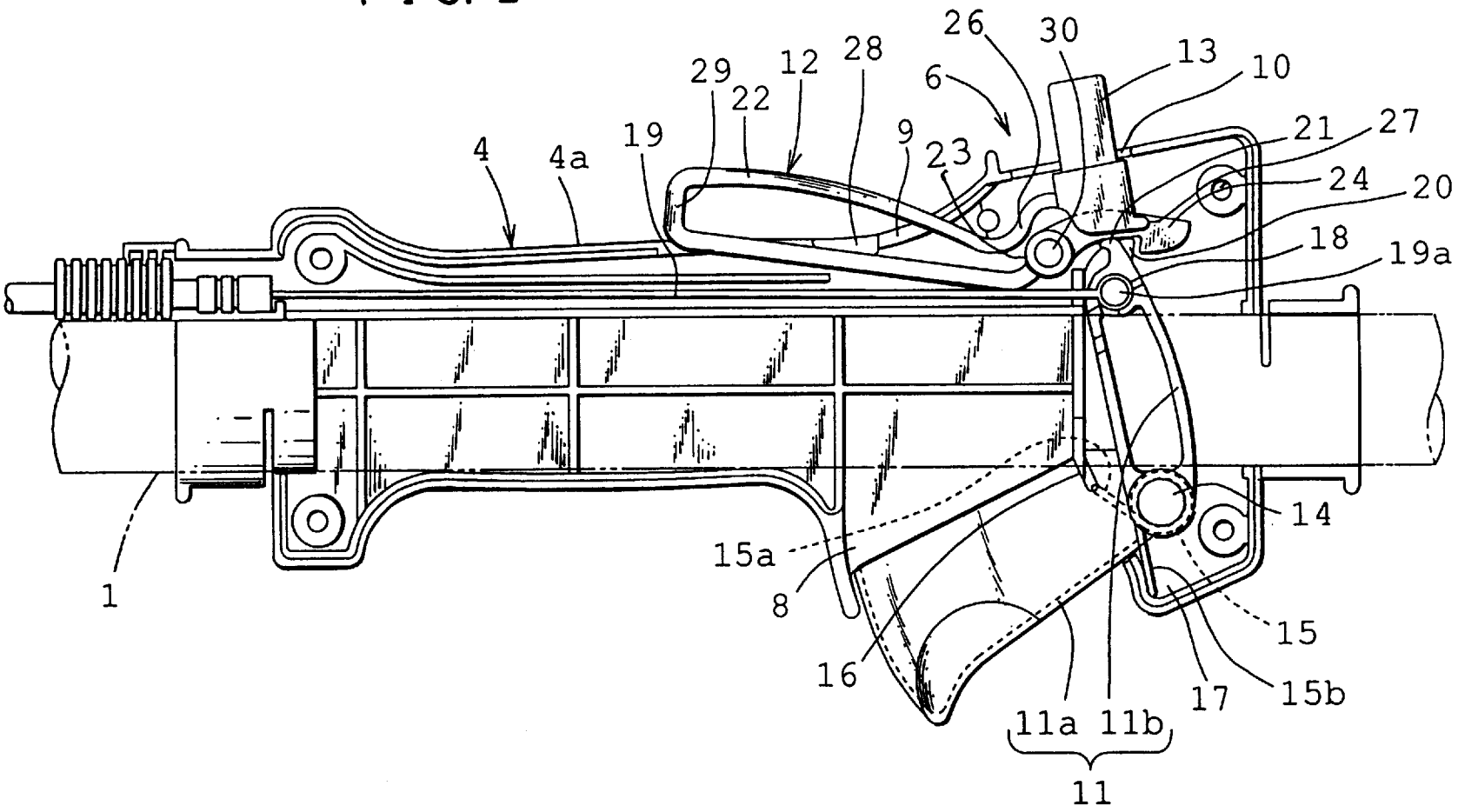
FIG. 2 is a sectional view through plane II—II of FIG. 1 showing an embodiment of a throttle lever device according to the present invention which is suitable for use for an engine of the mowing machine of FIG. 1.

Referring first to FIGS. 1 and 2, a mowing machine to which a throttle lever device according to the present invention may be applied is illustrated by way of example. The mowing machine includes a main rod 1 having a disc-shaped mowing blade 2 rotatably supported on one end thereof. The main rod 1 is mounted on the other end thereof with an engine 3 for driving the mowing blade 2. The main rod 1 is also mounted thereon with an operation grip 4 and an auxiliary rod 5. The operation grip 4 is thereon provided with a throttle lever device 6 for controlling rotation of the engine 3.

The operation grip 4 is constructed of first and second hollow grip members. In the illustrated embodiment, the operation grips 4 may be constructed of two grip halves 4*a* and 4*b* laterally split from each other along a longitudinal or central axis of the grip 4. More particularly, the grip halves 4*a* and 4*b* are joined together from both sides of the main rod 1 and then securely connected to each other by means of a combination of band fitments 7 and 7 with screws, resulting in the operation grip 4 being formed. Such joining of the grip halves 4*a* and 4*b* to provide the operation grip 4 permits a cavity or space formed with a first opening 8, a second opening 9 and a third opening 10 to be defined in the operation grip 4. The operation grip 4 is mounted with a throttle lever 11 for controlling the engine 3, a lock lever 12 engageable with the throttle lever 11, and a lock button 13 for holding the throttle lever 11 at a half throttling position through the openings 8, 9 and 10 in a manner to be movable and more particularly in a manner to be pushable in toward a center of the operation grip 4, respectively. The throttle lever 11 and lock lever 12 are arranged on the operation grip 4 so as to be substantially opposite to each other in a circumferential direction of the operation grip 4. In FIG. 2, the throttle lever 11 is arranged on a lower side of the operation grip 4 and the lock lever 12 is arranged on an upper side thereof. The lock button 13 is formed in a manner to be integral with the lock lever 12.

The throttle lever 11 includes a lever section 11*a* and a wire mounting section 11*b* which are joined to each other so as to form a substantially dog-legged shape. The throttle lever 11 is pivotally mounted on a support shaft 14 at a connecting portion thereof through which the lever section 11*a* and wire mounting section 11*b* are connected to each other. The support shaft 14 is mounted thereon with a helical spring 15, which is engaged at one end 15*a* thereof with a cutout 16 of the lever section 11*a* and at the other end 15*b* thereof with a recess 17 of the operation grip 4. The helical spring 15 functions to constantly outwardly urge the lever section 11*a*. The wire mounting section 11*b* is formed at a distal end thereof with a drum receiver 18, in which a drum 19*a* provided at an end of a throttle wire 19 is fitted. Thus, pivotal movement of the throttle lever 11 about the support shaft 14 causes the amount of movement of the throttle wire 19 to be varied, so that a throttling of the engine 3 may be adjusted and controlled.

Figure 3:
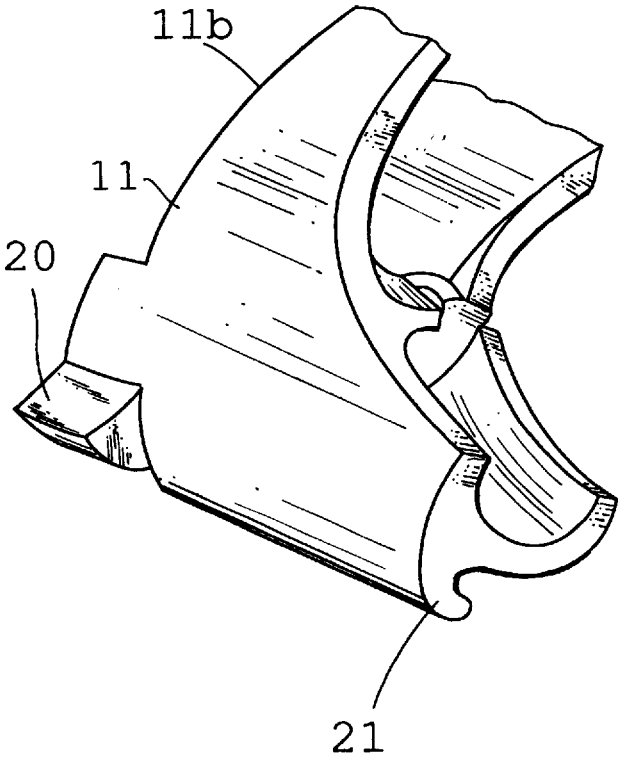
FIG. 3 is a fragmentary perspective view showing a part of a throttle lever.

The wire mounting section 11*b*, as shown in FIG. 3, is also provided at the distal end thereof with a first engagement 20 adapted to be engageable with the lock lever 12 and a second engagement 21 adapted to be engageable with the lock button 13. The first and second engagements 20 and 21 are arranged in juxtaposition to each other. The first engagement 20 is formed into an arcuate shape and the second engagement 21 is formed into a projection-like shape.

Figure 4:
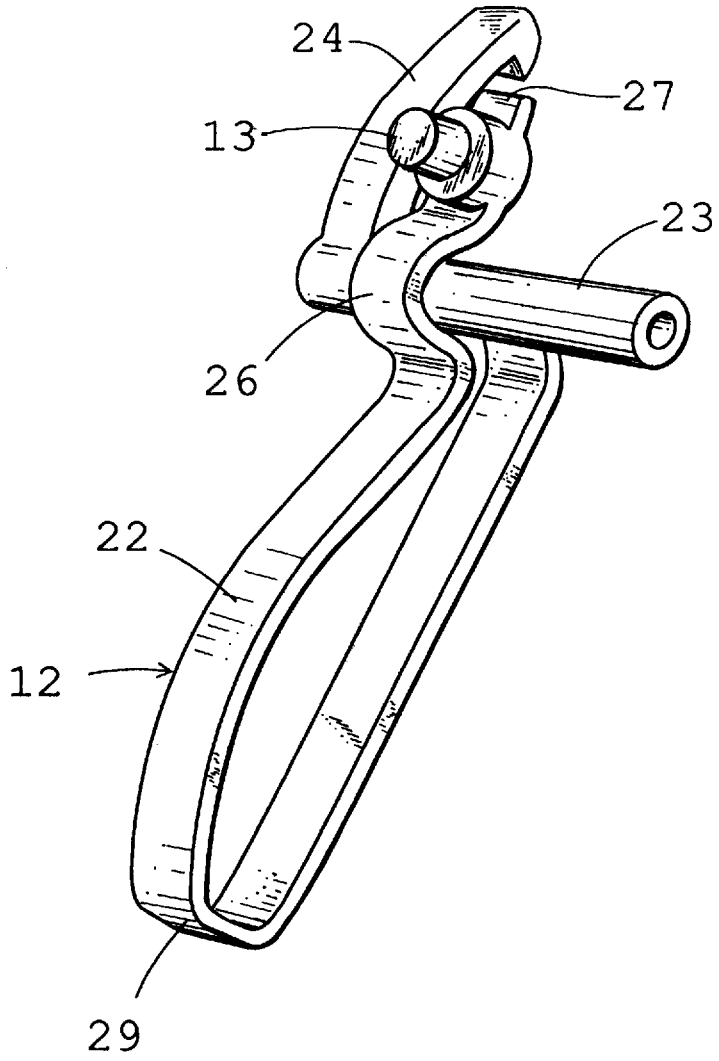
FIG. 4 is a perspective view showing a lock lever and a lock button.

The lock lever 12 and lock button 13 are each made of synthetic resin, such as polyacetal resin or the like, in a manner to be integral with each other and exhibit elasticity, as shown in FIGS. 2 and 4. The lock lever 12 is constructed of a handle 22 formed into a substantially U-shape and provided at one end thereof with a lock element 24 engageable with the throttle lever 11 through a bearing 23. The handle 22 is formed at the other end thereof with the lock button 13 through an extension 26. The handle 22 is arranged at the second opening 9 and the lock button 13 is arranged at the third opening 10. The lock button 13 is formed at a distal end thereof with a lock projection 27.

The bearing 23 is adapted to receive a support shaft 30 provided on the operation grip 4 and is arranged closer to the handle 22 of the lock lever 12 based on a center of the lock button 13 or deviated toward the handle 22 of the lock lever 12 from the lock button 13. The second opening 9 is formed on an edge thereof with an inwardly extending projection or regulation member 28. The projection 28 is arranged in a bent or folded section 29 of the lock lever 12, to thereby prevent the lock lever 12 from being outwardly dislocated. In the illustrated embodiment, the folded section 29 acts as an elastic means for urging the lock lever 12 and lock button 13, as well as an elastic hinge.

In the throttle lever device 6 of the illustrated embodiment constructed as described above, the handle 22 of the lock lever 12 is arranged in the second opening 9 and the lock button 13 is positioned in the third opening 10, resulting in elasticity of the bent or folded section 29 being suppressed, so that the lock button 13 is constantly urged so as to be projected outwardly of the third opening 10. Also, the support shaft 30, as described above, is arranged while being deviated toward the handle 22 of the lock lever 12 from the center of the lock button 13, so that the handle 22 is constantly elastically urged by the folded section 29 of the lock lever 12 so as to be outwardly projected from the second opening 9.

Now, the manner of operation of the throttle lever device 6 of the illustrated embodiment will be described hereinafter. In a normal state wherein the throttle lever 11, lock lever 12 and lock button 13 are kept non-operated, the throttle lever 11 is located at an end of pivotal movement thereof in a counterclockwise direction by elasticity of the helical spring 15 as shown in FIG. 2 and the lock lever 12 and lock button 13 are located at an end of pivotal movement thereof in a clockwise direction by elasticity of a material thereof. At this time, the first engagement 20 of the wire mounting section 11*b* of the throttle lever 11 is securely engaged with the lock element 24 of the lock lever 12. This keeps the throttle lever 11 from being rotated in the clockwise direction, so that the throttle lever 11 may not be pushedly operated or pushed in. Thus, the throttle wire 19 is kept from being pulled.

Figure 5:
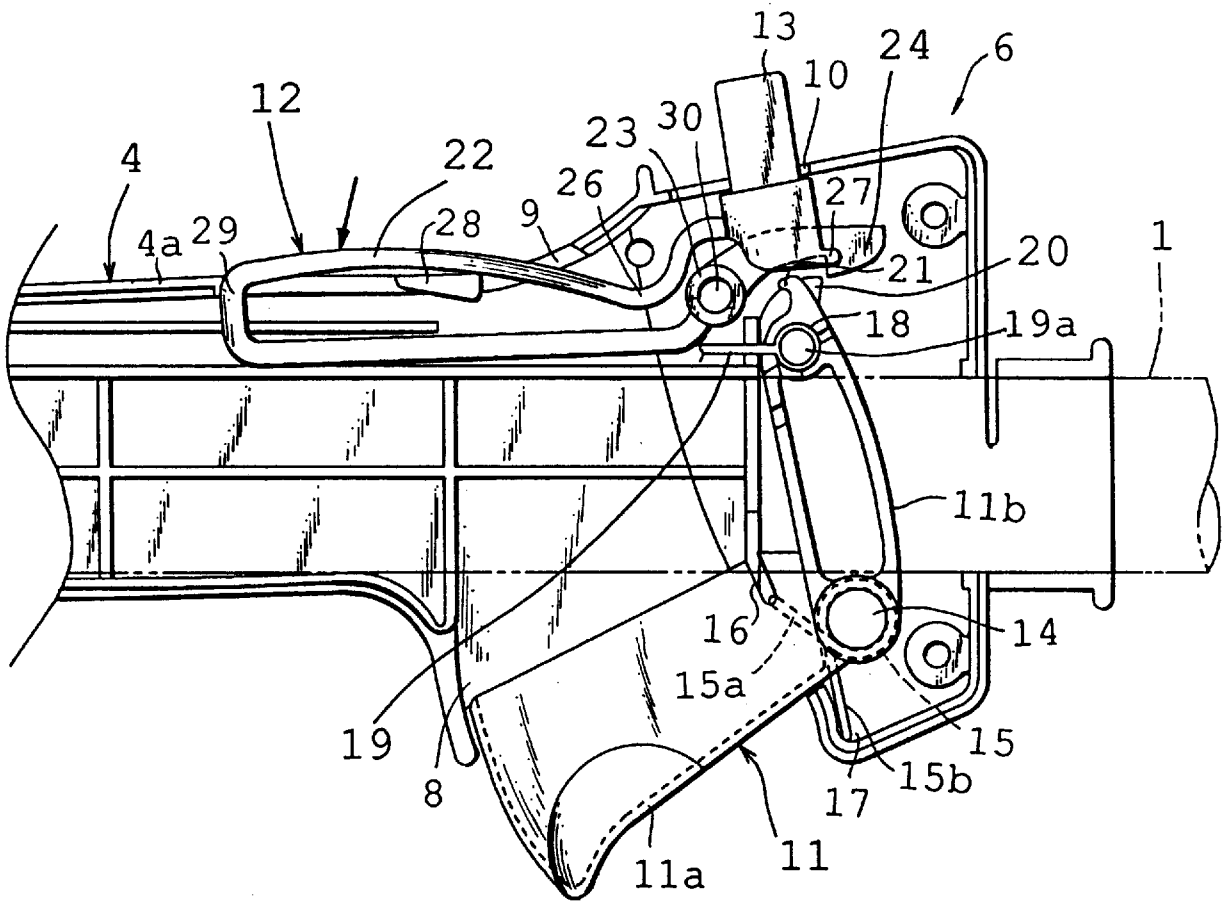

On the contrary, when the handle 22 of the lock lever 12, as shown in FIG. 5, is pushedly operated to pivotally move the lock lever 12 in the counterclockwise direction, the first engagement 20 of the throttle lever 11 is disengaged from the lock element 24, so that the throttle lever 11 may be pushedly operated or pushed in, resulting in the throttle wire 19 being rendered controllable.

Figure 6:
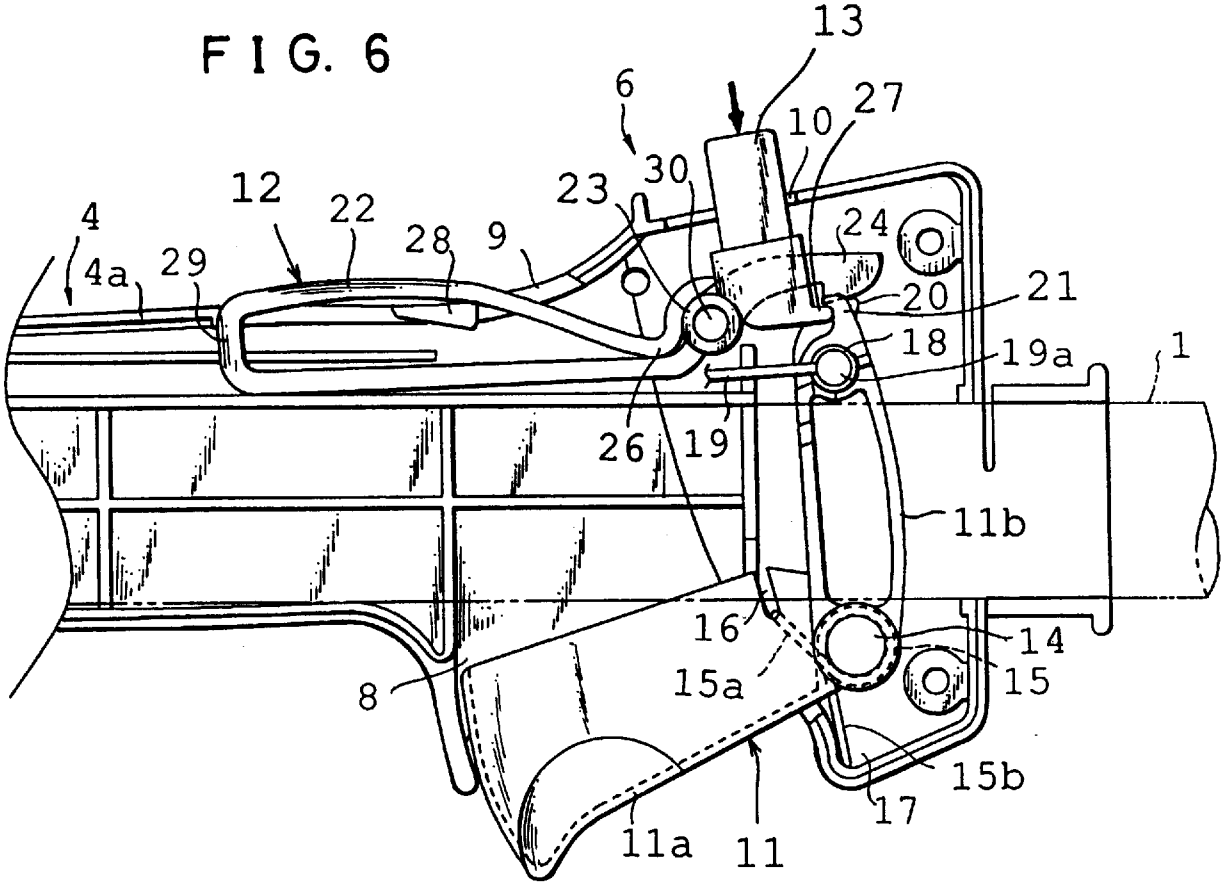

Then, when the throttle lever 11 is to be kept at a half throttling state at the time when the engine 3 is started, the throttle lever 11 is pushed in to a position somewhat beyond a half throttling position and then the lock button 13 is pushed in. Subsequently, when the throttle lever 11 is released, the lock projection 27 of the lock button 13 is securely engaged with the second engagement 21 of the throttle lever 11, resulting in preventing the throttle lever 11 from being further returned, so that the throttle lever 11 is kept at the half throttling position, as shown in FIG. 6.

When the throttle lever 11 is pushed further in after the engine 3 is started, the lock projection 27 of the lock button 13 is disengaged from the second engagement 21 of the throttle lever 11, resulting in the lock button 13 being outwardly forcedly moved by elasticity of the material thereof, so that free operation of the throttle lever 11 permits rotation of the engine 3 to be controlled.

When the throttle lever 11 and lock lever 12 are released during non-use of the mowing machine, a rest or the like, they are returned to a state shown in FIG. 2. Thus, the throttle lever 11 can be pushed in only after pushing-in of the lock lever 12.

As described above, the throttle lever device 6 of the illustrated embodiment is so constructed that the lock lever 12, lock button 13 and springs are formed integrally with each other. Thus, the throttle lever device 6 is significantly decreased in the number of parts as compared with the prior art.

Further, the prior art is so constructed that one of the grip halves of the operation grip is mounted thereon with two parts (throttle lever and spring) and the other grip half is mounted thereon with three members (lock lever, lock button and spring) in a manner to be separated from each other. On the contrary, the throttle lever device 6 of the illustrated embodiment permits the parts or members, that is, lock lever 12, lock button 13 and springs, which are formed integrally with each other, to be mounted on only one of the grip halves together with the throttle lever 11, resulting in an assembling operation thereof being highly facilitated.

Thus, it will be noted that the throttle lever device 6 of the illustrated embodiment reduces costs for both a material therefor and assembling thereof.

Further, the lock button 13 is pivotally moved about the folded section 29 of the lock lever 12 during push-in operation thereof. In this connection, the lock button 13 is arranged so as to be spaced at an increased distance from a center of pivotal movement thereof, so that it is linearly operated. This ensures that disengagement of the lock button 13 from the throttle lever 11 is smoothly carried out.

In the illustrated embodiment, the lock lever 12 and lock button 13 are integrally formed of elastic synthetic resin into a U-shape. However, the present invention is not limited to such construction wherein the resin material is used as an elastic means. For example, the illustrated embodiment may be constructed so that the lock lever 12 and lock button 13 are formed separately from each other and then integrally connected to each other, followed by projection of the lock lever 12 and lock button 13 through the corresponding openings of the operation grip 4 using a suitable elastic means such as springs. In this instance, it is preferable that the elastic means be integrally mounted on each of the lock lever 12 and lock button 13.

Moreover, in the illustrated embodiment, the main rod 1 is arranged so as to extend through the operation grip 4. Alternatively, the operation grip 4 is mounted on a distal end of the main rod 1.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A throttle lever device comprising:

an operation grip;

a throttle lever and a lock lever arranged on opposite sides of said operation grip and constructed for movement inward toward a center of said operation grip, said lock lever being arranged for engagement with said throttle lever; and a lock button for holding said throttle lever at a half throttling position, said lock button being arranged in proximity to said lock lever and constructed for movement inward toward the center of said operation grip;

said throttle lever being provided with a first engagement for engaging said lock lever and a second engagement for engaging said lock button;

said first engagement of said throttle lever being normally kept engaged with said lock lever and being released from engagement with said lock lever when said lock lever is pushed in;

said lock button being pushed in to the half throttling position, to thereby be engaged with said second engagement of said throttle lever when said throttle lever is pushed in to the half throttling position, resulting in said throttle lever being held at the half throttling position;

said lock button being released from engagement with said second engagement of said throttle lever when said throttle lever is pushed further in;

said lock lever and lock button being one-piece formed with each other and constantly urged by an elastic means so as to be projected outwardly of said operation grip;

said lock lever having a folded U-shape and provided at one end thereof with a lock element for engaging said first engagement of said throttle lever; and said lock lever being extended at the other end thereof and provided thereat with said lock button.

2. A throttle lever device as defined in claim 1, wherein said lock lever comprises a synthetic resin.

3. A throttle lever device as defined in claim 2, wherein said operation grip is constructed of first and second hollow grip members;

said throttle lever and lock lever being constructed for initial mounting in a single one of said grip members.

4. A throttle lever device as defined in claim 2, wherein said elastic means for urging said lock lever and lock button comprises a folded section of said lock lever which functions as an elastic hinge.

5. A throttle lever device as defined in claim 4, wherein said operation grip is provided with a regulation member for engaging said lock lever in order to prevent said lock lever from being excessively projected from said operation grip.

6. A throttle lever device as defined in claim 1, wherein said lock lever is pivotally supported on said operation grip; and said throttle lever includes a throttle wire mounting section and a lever section for operation and is pivotally supported on said operation grip;

said lever section being urged by a spring member so as to be projected outwardly of said operation grip.

7. A throttle lever device as defined in claim 6, wherein said operation grip is constructed of first and second hollow grip members;

said throttle lever and lock lever being constructed for initial mounting in a single one of said grip members.

8. A throttle lever device as defined in claim 6, wherein said elastic means for urging said lock lever and lock button comprises a folded section of said lock lever which functions as an elastic hinge.

9. A throttle lever device as defined in claim 8, wherein said operation grip is provided with a regulation member for engaging said lock lever in order to prevent said lock lever from being excessively projected from said operation grip.

10. A throttle lever device as defined in claim 1, wherein said operation grip is constructed of first and second hollow grip members; said throttle lever and lock lever being constructed for initial mounting in a single one of said grip members.

11. A throttle lever device as defined in claim 10, wherein said elastic means for urging said lock lever and lock button comprises a folded section of said lock lever which functions as an elastic hinge.

12. A throttle lever device as defined in claim 11, wherein said operation grip is provided with a regulation member for engaging said lock lever in order to prevent said lock lever from being excessively projected from said operation grip.

* * * * *

UNITED STATES PATENT AND TRADEMARK OFFICE

CERTIFICATE OF CORRECTION

PATENT NO. : 5,862,713

DATED : Jan. 26,1999

INVENTOR(S) : Tsunoda et al.

It is certified that error appears in the above-identified patent and that said Letters Patent is hereby corrected as shown below:

On the Title Page, item [75], "Takasaki-gun" should read --Takasaki-shi--.

On the Title Page, item [75], "Gunma " should read --Gunma-gun--.

Column 3, line 1, delete "showing".

Column 3, line 2, after "1" insert --showing--.

Signed and Sealed this

Twentieth Day of July, 1999

*Attest:*

*Attesting Officer*

Q. TODD DICKINSON

*Acting Commissioner of Patents and Trademarks*